US007397441B1

(12) United States Patent
Zweers

(10) Patent No.: US 7,397,441 B1
(45) Date of Patent: Jul. 8, 2008

(54) ANTENNA ELEMENT FOR A PORTABLE COMMUNICATION DEVICE

(75) Inventor: Jan-Willem Zweers, Wezep (NL)

(73) Assignee: Sony Ericsson Mobile Communications AB, Lund (SE)

( * ) Notice: Subject to any disclaimer, the term of this patent is extended or adjusted under 35 U.S.C. 154(b) by 0 days.

(21) Appl. No.: 11/681,347

(22) Filed: Mar. 2, 2007

Related U.S. Application Data

(60) Provisional application No. 60/887,910, filed on Feb. 2, 2007.

(51) Int. Cl.
*H01Q 7/00* (2006.01)

(52) U.S. Cl. ..... 343/866; 343/702; 343/741; 343/895

(58) Field of Classification Search ..... 343/702, 343/741, 742, 866, 867, 846, 718, 895
See application file for complete search history.

(56) References Cited

U.S. PATENT DOCUMENTS 2,273,955 A * 2/1942 Grimditch ..... 343/842
3,518,681 A * 6/1970 Kiepe ..... 343/702
4,161,737 A * 7/1979 Albright ..... 343/749
5,847,683 A 12/1998 Wolfe et al.
6,163,300 A * 12/2000 Ishikawa et al. ..... 343/702
6,952,186 B2 * 10/2005 Saito et al. ..... 343/702
2004/0119657 A1 6/2004 Mayer et al.

FOREIGN PATENT DOCUMENTS

EP 1 416 585 5/2004
FR 2 245 097 4/1975

OTHER PUBLICATIONS

International Search Report with Written Opinion for corresponding PCT Application No. PCT/EP2007/057921 dated Oct. 8, 2007, 8 pages.

* cited by examiner

*Primary Examiner*—Tho G Phan
(74) *Attorney, Agent, or Firm*—Harrity Snyder, LLP

(57) ABSTRACT

The present invention relates to an antenna element for a portable communication device as well as to a portable communication device including such an antenna element. The antenna element includes a wire of an electrically conducting material having a first and a second feeding end for connection to a radio communication unit and ground. The wire also has a winding section comprising a number of turns around a central axis. The last turn of the winding section, which is provided furthest from the first feeding end is in physical contact with the previous turn and the rest of the turns are separated from each other.

16 Claims, 2 Drawing Sheets

ANTENNA ELEMENT FOR A PORTABLE COMMUNICATION DEVICE

RELATED APPLICATION

This application claims priority under 35 U.S.C. § 119 based on U.S. Provisional Application Ser. No. 60/887,910, filed Feb. 2, 2007, the disclosure of which is incorporated herein by reference.

TECHNICAL FIELD OF THE INVENTION

The present invention relates to antennas for communication devices and, more particularly, to an antenna element and a portable communication device including such an antenna element.

DESCRIPTION OF RELATED ART

Portable communication devices (e.g., headphones) that are provided as accessories to a "host" portable communication device, such as a mobile phone, may be configured to communicate with the host portable communication device via a wireless connection. A variety of wireless communication technologies exists, which includes the widely-popular Bluetooth™ technology. However, other radio standards and wireless communication protocols exist, such as UWB (ultra wide band).

The dimensions of antenna arrangements to be used in wireless communication devices necessarily conform to the diminutive design of the portable communication devices in which the antennas reside. This is often the case for many devices that use short-range, high frequency communication, for instance, according to the Bluetooth™ or similar communication protocol. Examples of typical Bluetooth™ devices include headsets, such as streaming audio headsets and voice headsets, handsfree devices, music players, and cameras, which communicate with, for instance, a cellular phone using Bluetooth™. Such devices thus often need to be of limited size, while at the same time being able to operate within a certain frequency band and, in the case of Bluetooth™ specifications, typically around 2.45 GHz or higher.

The antennas of such communication devices are typically used while being placed in close proximity to the user's body. The human body is very effective in absorbing radio energy (i.e., shielding radio waves), thus resulting in de-tuning of the antenna. As such, the efficiency of an antenna that is positioned close to the user's body may be diminished to an unacceptable level. Accordingly, with respect to wireless devices, such as headsets, attenuation by the user's body with reception/transmission of signals should be taken into consideration.

Previous attempts to address this phenomenon include using a directional antenna, such as a PIFA (Planar Inverted F Antenna). Another type of system is described in EP 1 416 585, in which a loop antenna is provided around a circumference of a circuit board, in an attempt to direct antenna signals away from the user's body. Such configurations function best when the host portable communication device is to be worn in a substantially fixed position relative to the body of the user, such that the signals will radiate in a direction unobstructed by the user's body during operation.

However, such portable communication devices may not only be designed to be worn as attached to the body, but to be worn alternatively loosely relative to the body, such as hanging on a lanyard that the may be draped around the neck of the user. In this regard, the portable communication device may be displaced into various orientations relative to the body. When the portable communication device, in the course of being moved while worn, assumes a contrary orientation relative to the antenna, radio signals may be directed toward the user's body and thereby obstructed. A communication with the host communication device may be adversely affected or entirely attenuated.

Accordingly, with respect to devices that are small and may be worn so as to assume random orientations, directional antennas may be subject to diminished performance.

Aside from customary antenna parameters, an optimally performing antenna susceptible to random positioning near a user's body would preferably exhibit one or more the following properties:

- More than enough bandwidth in the frequency range that is of interest.
- Superior efficiency over a bandwidth larger than the bandwidth of the frequency range of interest.
- Maintainable sufficient effective distance between user's body and the antenna.
- Substantially omni-directional antenna directivity.

SUMMARY OF THE INVENTION

Implementations of the present invention may enable the provision of a superior internal antenna in a compact portable communication device.

Implementations of the present invention are based on Applicant's insight that for small portable communication devices that employ internal antennas, the component that is typically termed an antenna only partially contributes to the radiation emanated from the device, where other elements that influence such radiation include other, larger electrically conductive elements of the device, such as a chassis and a circuit board and its components. Such elements or mass blocks may then be capacitively and/or inductively coupled to the associated antenna element. The antenna element that is customarily deemed as the antenna, therefore, actually functions as an exciter for such mass blocks. A consideration then becomes as how to make such mass blocks radiate more efficiently.

Implementations of the present invention may provide an antenna element that enables the provision of a superior antenna, for example, in a small portable communication device.

According to a first aspect of the present invention, an antenna element for a portable communication device includes a wire of an electrically conducting material having a first and a second feeding end for connection to a radio communication unit and ground, the wire having a winding section comprising a number of turns around a central axis, where the last turn, which is provided furthest from the first feeding end, is in physical contact with the previous turn and the rest of the turns are separated from each other.

A second aspect of the present invention is directed to an antenna element including the features of the first aspect, wherein an area of contact between the last turn and previous turn is provided at the distal end of the last turn.

A third aspect of the present invention is directed to an antenna element including the features of the first aspect, further including a return section joined to the distal end of the last turn of the winding section and leading back towards and past the first turn in parallel with the central axis.

A fourth aspect of the present invention is directed to an antenna element including the features of the third aspect, wherein the return section is provided inside the turns of the winding section.

A fifth aspect of the present invention is directed to an antenna element including the features of the third aspect, wherein the second feeding end is provided at the end of the return section furthermost from the where the return section is joined to the winding section and in parallel with the first feeding end in a feeding plane that is substantially perpendicular to the central axis.

A sixth aspect of the present invention is directed to an antenna element including the features of the first aspect, wherein the first feeding end is provided in an input section connected to the first turn of the winding section.

A seventh aspect of the present invention is directed to an antenna element including the features of the first aspect, wherein the first turn is distanced from the last turn with a first distance in the direction of the central axis and all turns of the winding section are distanced at least a second distance from the central axis to provide a three-dimensional antenna element volume determined at least by the first and second distances.

An eighth aspect of the present invention is directed to an antenna element including the features of the first aspect, wherein the turns have circular shape.

A ninth aspect of the present invention is directed to an antenna element including the features of the first aspect, wherein the turns have elliptical shape.

A tenth aspect of the present invention is directed to an antenna element including the features of the first aspect, wherein the turns have rectangular shape.

Other implementations of the present invention provide a small portable communication device including an antenna element that allows the provision of an improved antenna.

According to an eleventh aspect of the present invention, a portable communication device includes a radio communication unit, a ground plane, at least one mass block, and an antenna element. The antenna element includes a wire of an electrically conducting material having a first and a second feeding end for connection to the radio communication unit and ground, the wire having a winding section comprising a number of turns around a central axis, where the last turn, which is provided furthest from the first feeding end, is in physical contact with the previous turn and the rest of the turns are separated from each other.

A twelfth aspect of the present invention is directed to a portable communication device including the features of the eleventh aspect, wherein an area of contact between the last turn and previous turn of the winding section is provided at the distal end of the last turn.

A thirteenth aspect of the present invention is directed to a portable communication device including the features of the eleventh aspect, further including a return section joined to the distal end of the last turn of the winding section and leading back towards and past the first turn in parallel with the central axis.

A fourteenth aspect of the present invention is directed to a portable communication device including the features of the thirteenth aspect, wherein the return section is provided inside the turns of the winding section.

A fifteenth aspect of the present invention is directed to a portable communication device including the features of the thirteenth aspect, wherein the second feeding end is provided at the end of the return section furthermost from the where the return section is joined to the winding section and in parallel with the first feeding end in a feeding plane, which feeding plane is perpendicular to the central axis.

A sixteenth nineteenth aspect of the present invention is directed to a portable communication device including the features of the eleventh aspect, wherein it is an accessory for a wireless communication terminal.

Implementations of the invention have a number of advantages. For example, the portable communication device may provide a broadband omnidirectional antenna. The subject antenna may be furthermore efficient, both in free space and proximate to a user's body over a broad range of frequencies. Implementations may be incomplex and/or produced at a relatively low cost. Furthermore, one or more of the above characteristics may be accomplished in implementations of comparatively limited overall dimensions.

It should be appreciated that the terms "comprises/comprising" and/or "includes/including," when used in this specification, are taken to specify the presence of stated features, integers, steps or components, but do not preclude the presence or addition of one or more other features, integers, steps, components or groups thereof.

BRIEF DESCRIPTION OF THE DRAWINGS

The present invention will now be described in more detail in relation to the enclosed drawings, in which.

DETAILED DESCRIPTION

Figure 1:
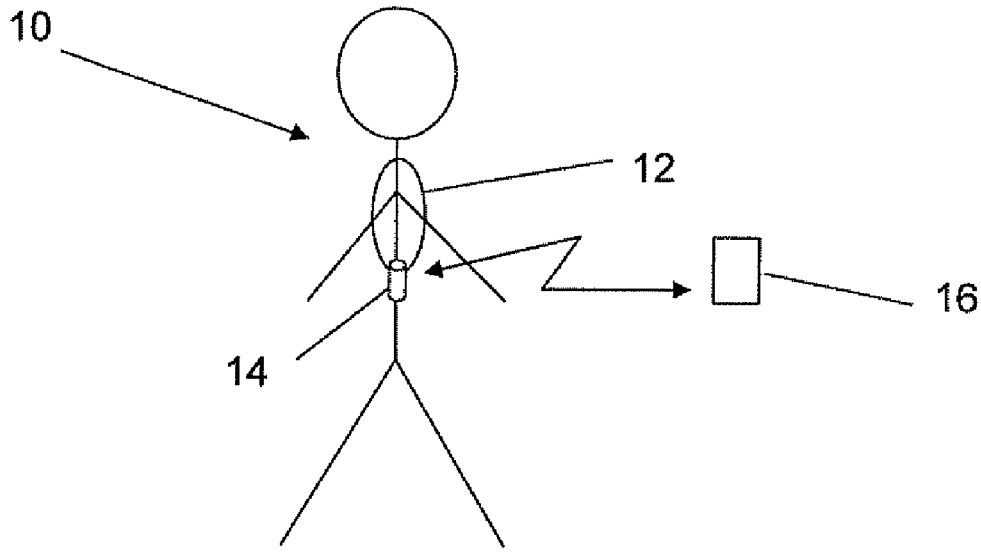
FIG. 1 schematically shows a user of an exemplary device in which systems of the present invention may be implemented.

FIG. 1 schematically shows a user 10 wearing a first communication device 14. First communication device 14 may be worn loosely relative to the body of user 10, for example, through being disposed on a string or lanyard 12 that hangs from the neck of user 10. Alternatively, first communication device 14 may fasten to user 10 with a type of fastener, such as a clip. First communication device 14 may be configured to communicate with a second communication device 16, as well as to other devices (not shown).

Communication between first and second communication devices 14 and 16 may be enabled, for example, using a suitable short-range communication technique, which according to various implementations of the present invention, may include Bluetooth™ technology. The invention is however not limited to Bluethooth™, but can use other suitable communication techniques and communication bands, for instance the UWB (ultra wide band) frequency range. The invention is not limited to being applied in these ranges, but can be used also in other frequency ranges such as in various GSM, UMTS, WLAN, or any other suitable bands.

First small device 14 may be configured to send and/or receive data such as streamed audio and/or voice, as well as provide different types of signals, e.g., control for second larger device 16. Small device 14 may include an antenna to be used for one or more of these functions.

As first device 14 hangs loosely on (e.g., dangles from) the body of user 10, the orientation of the antenna may be subject to vary. To enable suitable functionality, the antenna associated with first device 14 may be substantially omni-directional and the amount of inference with signal transmission caused by the body of user 10 should desirably be minimized. The antenna associated with first device 14 should desirably operate over a wide enough band for communicating according to desired communication standards and be efficient within those bands.

In this regard, the present invention is based on recognition that for a small portable communication device that includes an internal antenna, the element that is referred to as the "antenna" is not the sole source of the radiation from the device. Other components of the device that influence such radiation are the larger electrically conductive elements of the device, such as a chassis and/or a circuit board with components. The larger elements, which are hereinafter referred to generally as "mass blocks," may be capacitively and/or inductively coupled to the "antenna." The "antenna," therefore, functions as an exciter for the mass blocks. Implementations of the present invention are therefore directed to providing an antenna element or exciter that makes such mass-elements radiate omni-directionally and more efficiently in a wide enough frequency range.

Figure 2:
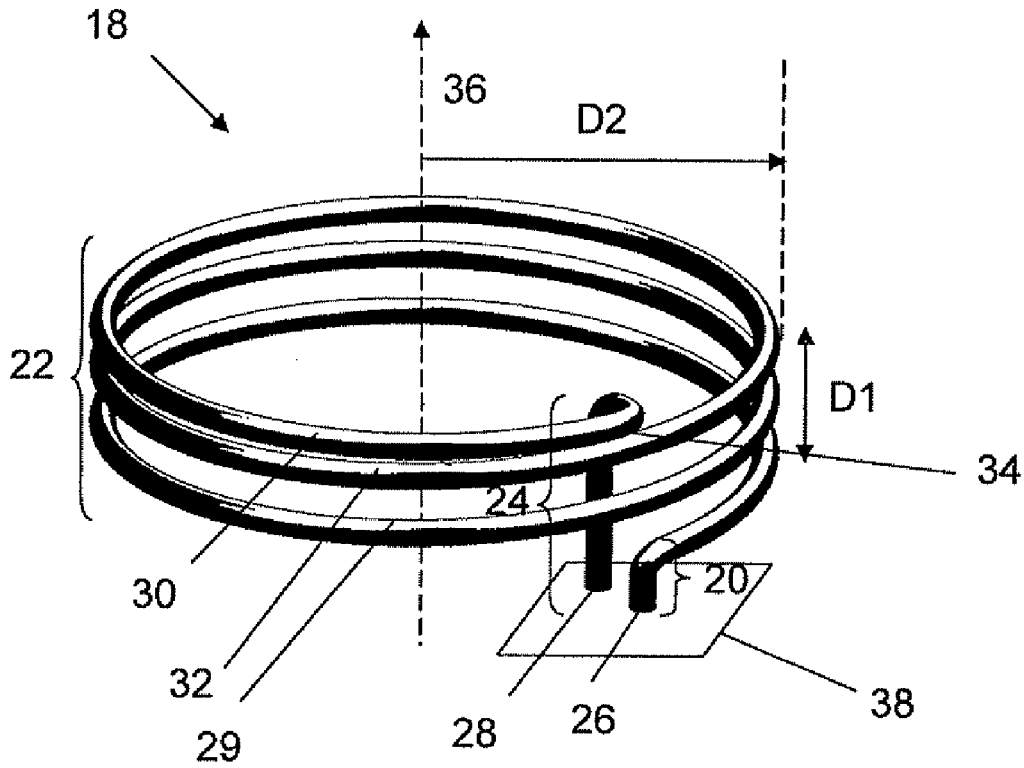
FIG. 2 shows a perspective view of an antenna element according to the present invention.

FIG. 2 shows a perspective view of an exemplary antenna element or exciter 18 that may be provided in first communication device 14 of FIG. 1.

Antenna element or exciter 18, for example, may be made from a wire of electrically conducting material. The wire may include a first feeding end 26 and a second feeding end 28 that may connect to a radio communication unit and ground. First feeding end 26 may be provided in an input section 20 of antenna exciter element 18 that is substantially straight and joined to a first turn 29 of a winding section 22. Winding section 22 may includes a number of turns 29, 30, 32 of the wire around a central axis 36, and input section 20 may extend a short length substantially in parallel with central axis 36. Thus input section 38 may be joined at substantially right angles to winding section 22.

In the embodiment shown in FIG. 2, first turn 29, penultimate turn 32, and final turn 30, collectively, turns 29, 30, 32, may have a substantially helical shape and thus the structure of winding section 22 may include any number of turns that move gradually upwards along central axis 36. Other shapes are possible. Shapes may vary among turns 29, 30, 32. In FIG. 2 there are shown three turns 29, 30, 32. However, it should be appreciated that the number of turns may vary.

Final turn 30, which may be provided furthest from first feeding end 26, may be in physical contact at one or more points with penultimate turn 32. In contrast, the other ones of the turns may be separated from each other by gaps of suitable and possibly varying distances. So configured, winding section may have a height D1 in the direction of central axis 36 that is determined by the number of turns 29, 30, 32, the cross-sectional area of the wire, and the gaps between the turns. Height D1 may provide a first distance between first turn 29 and final turn 30 of winding section 22. A gap may be provided between most of final turn 30 and penultimate turn 32.

Each of turns 29, 30 and 32 of winding section 22 may be disposed at a second distance D2 from central axis 36 (e.g., the radius of the helical structure formed by turns 29, 30, 32). In one embodiment according to FIG. 2, substantially every point on each of turns 29, 30, 32 is a distance D2 to central axis 36 to thereby define the helical structure. Final turn 30 may, at its distal end, be joined at approximately a ninety degree angle to a return section 24, which may lead directly back toward and past first turn 29, substantially in parallel with central axis 36. An area or point of contact 34 between final turn 30 and penultimate turn 32 may be provided pointing the area where final turn 30 is joined to the return section 24. In FIG. 2, return section 24 is shown as running inside winding section 22. Alternatively, return section 24 may run on the outside of winding section 22. Return section 24 may not contact any other than final turn 30.

Return section 24 may terminate in a feeding plane 38 that may be substantially perpendicular to central axis 36. Feeding plane 38 may be provided furthermost from where return section 24 is joined to winding section 22. Second feeding end 28, which may be provided at the end of return section 24, as well as first feeding end 26, may both be disposed in feeding plane 38.

As configured, the structure extending in three dimensions, antenna exciter element 18 may have a low impedance side provided at about a top of winding section 22 in the direction of central axis 36, and an opposite low impedance side in the opposite direction of central axis 36 at input and return sections 20 and 24. The low impedance, for example, may be approximately 50Ω or so. Other impedances are possible. Antenna exciter element 18 may have a high impedance from a about winding section 22 in a direction radially outward from about central axis 36. First and second distances D1 and D2 may determine a substantial three-dimensional element volume for antenna exciter element 18. Any one or more of the above-described parameters may, according to the present invention, be used for enhancing the properties of an antenna arrangement that includes antenna exciter element 18 according to implementations of the invention.

Figure 3:
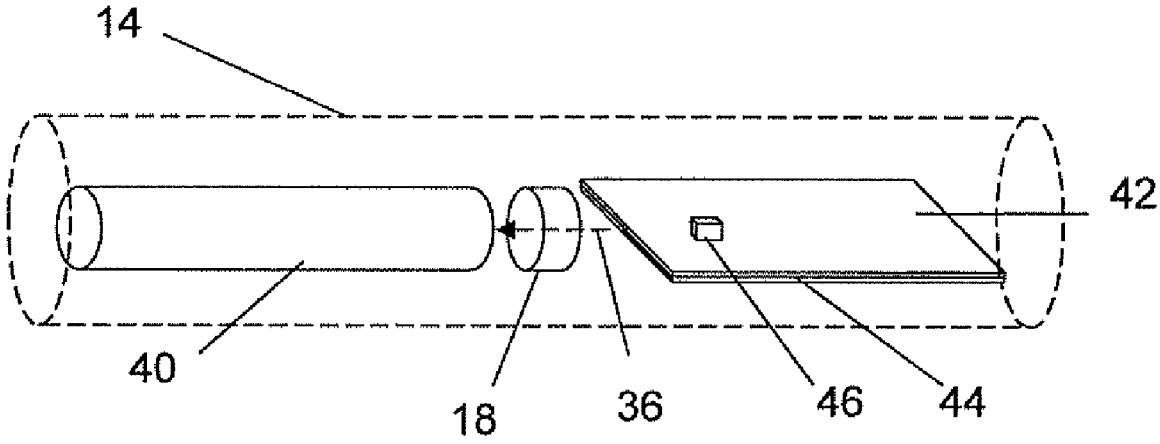
FIG. 3 schematically shows an exemplary antenna exciter element provided together with two mass blocks for use in an exemplary device for providing an antenna arrangement according to one embodiment of the present invention.

FIG. 3 schematically shows an antenna arrangement according to the principles of the present invention to be provided inside first communication device 14. First communication device 14 may include a housing or casing which encloses elements of the antenna unit. First communication device 14 may, of course, have other shapes, such as a cubic-like shape.

In one implementation, antenna element or exciter 18 may be centrally provided in first communication device 14, for example, along central axis 36, as shown. In one implementation, a first mass block 40 and a second mass block 42, collectively, mass blocks 40 and 42, may be disposed on opposing sides of antenna element or exciter 18, for example, along central axis 36. Mass blocks 40 and 42 may be aligned with antenna element or exciter 18 in the direction of central axis 36.

A gap may be provided between each of mass blocks 40 and 42 and antenna element or exciter 18. In FIG. 3, the exemplary gaps are shown as being relatively large to clearly show their existences. It should be appreciated, however, that in practicing the various implementations, the gaps may be much smaller (shorter), for example, to obtain adequate coupling between antenna exciter element 18 and mass blocks 40 and 42.

First mass block 40 is shown as having an exemplifying cylindrical shape, while second mass block 42 is shown as having a substantially flat rectangular or planar shape. It should be appreciated, however, that mass blocks 40 and 42 may have any suitable shape and/or dimensions. In one implementation, second mass block 42 may include a circuit board that may be provided with a ground plane 44 disposed in the interior of the circuit board and with, for example, a radio communication unit 46, and first mass block 42 may include a battery. It should be appreciated that the board may have several different other units than radio communication unit 46. However, these have here been omitted for ease of describing the various implementations of the present invention.

Mass blocks 40 and 42 may be include any number of various electrically conducting parts that may be used for the operation of first communication device 14. Examples of such parts include inner components (e.g., electronic, mechanical, battery, PCB, etc), but also other parts, such as shielding, electrically conducting parts of the casing and chassis may be used. The inner components of mass blocks 40 and 42 may thus both be covered by a separate metal casing. At least one of mass blocks 40 and 42 may have an substantially three-dimensional volume that may have a section that faces and covers the low-impedance side of antenna element or exciter 18 in a plane that is substantially perpendicular to central axis 36.

One of first and second feeding ends 26 and 28 of antenna element or exciter 18 may connect to radio communication unit 46 while the other of first and second feeding ends 26 and 28 may connect to ground 44. In some implementations, it may be irrelevant which one of first and second feeding ends 26 and 28 is connected to which.

With the above-mentioned orientations of mass blocks 40 and 42 relative to antenna element or exciter 18, mass blocks 40 and 42 may be readily excited by antenna element or exciter 18 because of the low impedance between them. The coupling to the closely provided mass blocks 40 and 42 may be accomplished in such a way that the complete antenna unit may obtain its desired impedance. The coupling may occur in the near-field region mainly via the shorted final turn 30 of winding section 22 and input and return sections 20 and 24 of antenna element or exciter 18.

Since both antenna element or exciter 18 and at least one of mass blocks 40 and 42 may be three-dimensional structures, the resulting antenna unit may be less sensitive to detrimental effects associated with being operated close to the body of user 10. Exemplary structure implementations may provide an antenna unit that covers a wide frequency band. The antenna unit may thus render it possible to provide a complete small RF (radio frequency) wireless device with very good RF performance operating near the body of user 10. Because of the large bandwidth, the antenna unit may be very good for the UWB standard in addition to use for the Bluetooth™ standard. The radiation produced by the antenna unit may be substantially omni-directional.

Figure 4:
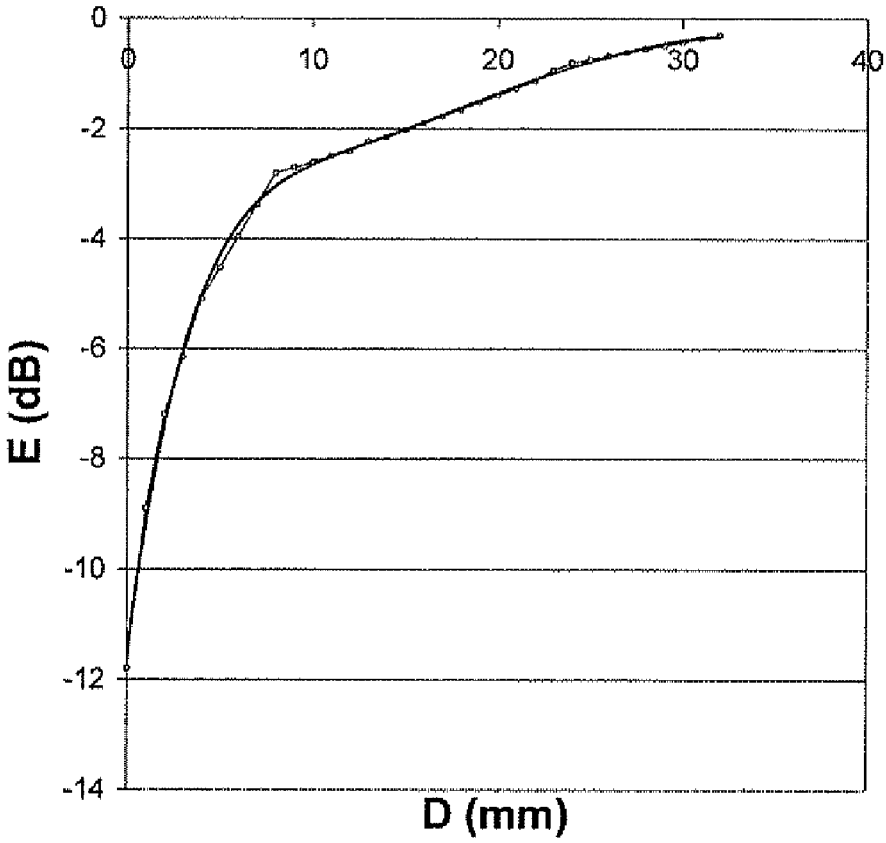
FIG. 4 shows a plot of antenna efficiency as a function of the distance to a user's body for an antenna arrangement provided according to the principles of the present invention.

FIG. 4 shows a chart that graphs an efficiency E of an antenna unit according to an exemplary embodiment relative to the distance D to the body of user 10, where efficiency E is expressed in dB and distance D in mm. As can be seen from the graph, the antenna unit exhibits a comparatively good efficiency in operation proximate the body. The antenna unit likewise exhibits also has good free space efficiency.

Such an antenna unit can furthermore have a big bandwidth over which it may cover the frequencies of from about 1.8 to about 10.6 GHz. Also, the efficiency of the antenna unit is good over entire band.

The antenna element is also incomplex and may be produced at a comparatively low cost and enable the provision of an antenna in a small portable communication device, such as a headset or earpiece.

The present invention can be varied in many ways. For example, the length of the wire, the cross-sectional area of the wire, the number of turns, and the first and second distances mentioned above may be selected depending on frequency and bandwidth requirements. For example, the length of the wire, excluding the final turn, may be adapted to correspond to the bandwidth, over which it is desirable to cover. In the described above, the winding section had a helical shape, i.e., the turns were essentially circular around the central axis. However, they may also have different shapes, like essentially elliptical and essentially rectangular. The mass blocks were also above shown as being coupled to the exciter along the central axis. It should be appreciated, however, that one or both may be coupled via a lateral side provided by the winding section, i.e., coupled to the exciter perpendicular to the central axis.

In view of the above and previously mentioned modifications of the present invention, it should be appreciate that the present invention is only to be limited by the following claims.

What is claimed is:

1. An antenna element including an electrically conductive wire, the electrically conductive wire comprising:

a first feeding end connected to a radio communication unit and a ground;

a second feeding end connected to the radio communication unit and the ground; and a winding section including a number of turns about a central axis, wherein a final one of the turns that is furthest from the first feeding end contacts a penultimate one of the turns, and others of the turns are not in contact with each other.

2. The antenna element of claim 1, wherein contact between the final turn and the penultimate turn occurs at a distal end of the final turn.

3. The antenna element of claim 2, further comprising a return section disposed at a distal end of the final turn and extending toward and past a first one of the turns.

4. The antenna element of claim 3, wherein the return section is at least partially disposed in an inner diameter of the turns of the winding section.

5. The antenna element of claim 3, wherein the second feeding end is disposed at an end of the return section furthest from where the return section is joined to the final return and connected to a feeding plane that is substantially perpendicular to the central axis.

6. The antenna element of claim 1, wherein the first feeding end is disposed in an input section connected to a first one of the turns.

7. The antenna element of claim 1, a first distance separating a first one of the turns from the final turn along the central axis, and a second distance separating an inner diameter of the turns from the central axis, wherein a volume of the antenna element is defined by at least the first and second distances.

8. The antenna element of claim 1, wherein the turns have a substantially circular shape.

9. The antenna element of claim 1, wherein the turns have a substantially elliptical shape.

10. The antenna element of claim 1, wherein the turns have a substantially rectangular shape.

11. A communication device including a radio communication unit, a ground plane, at least one mass block, and an antenna element, the antenna element comprising:

an electrically conductive wire including:

a first feeding end connected to the radio communication unit and the ground plane, a second feeding end connected to the radio communication unit and the ground plane, and a winding section including a number of windings about a central axis, wherein a final winding of the winding section contacts a penultimate winding of the winding section, and others of the windings are separated from each other.

12. The communication device of claim 11, wherein the contact between the final winding and the penultimate winding is at a distal end of the final winding.

13. The communication device of claim 11, further comprising a return section joined to the distal end of the final winding and extending substantially in parallel with the central axis and past a first winding of the winding section.

14. The communication device of claim 13, wherein the return section is at least partially inside the windings.

15. The communication device of claim 13, wherein the second feeding end is disposed at an end of the return section that opposes the distal end of the final winding, substantially parallel with the first feeding end, and in a feeding plane that is substantially perpendicular to the central axis.

16. The communication device of claim 11, wherein the antenna element resides in a wireless communication terminal.

* * * * *